US006520336B2

(12) United States Patent
Baechle

(10) Patent No.: US 6,520,336 B2
(45) Date of Patent: Feb. 18, 2003

(54) EXTRUDED CORNER POST FOR VERTICAL AND LATERAL PROTECTION

(75) Inventor: James Baechle, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 55 days.

(21) Appl. No.: 09/828,369

(22) Filed: Apr. 4, 2001

(65) Prior Publication Data

US 2002/0144923 A1 Oct. 10, 2002

(51) Int. Cl.[7] ..... B65D 81/05
(52) U.S. Cl. ..... 206/586; 206/320
(58) Field of Search ..... 206/453, 586, 206/594, 320; 248/345.1; 428/35.7, 36.5

(56) References Cited

U.S. PATENT DOCUMENTS

| | | | | |
|---|---|---|---|---|
| 3,935,357 A | | 1/1975 | Padovani | |
| 4,202,449 A | | 5/1980 | Bendt | |
| 4,244,471 A | | 1/1981 | Plante | |
| 4,482,054 A | * | 11/1984 | Gardner | 206/586 |
| 4,483,444 A | | 11/1984 | Gardner | |
| 4,874,095 A | * | 10/1989 | Warych | 206/586 |
| 5,149,575 A | * | 9/1992 | Soifer | 248/345.1 |
| 5,267,651 A | | 12/1993 | Hughes | |
| 5,593,039 A | | 1/1997 | Ortlieb | |
| 5,918,800 A | | 7/1999 | Goshorn et al. | |
| 6,059,104 A | | 5/2000 | Widman | |
| 6,186,329 B1 | * | 2/2001 | Qiu | 206/586 |
| 6,234,314 B1 | * | 5/2001 | Qiu et al. | 206/586 |
| 6,247,596 B1 | * | 6/2001 | Muyskens | 206/586 |
| 6,286,683 B1 | * | 9/2001 | Hunt et al. | 206/586 |

* cited by examiner

*Primary Examiner*—Jim Foster
(74) *Attorney, Agent, or Firm*—Bullwinkel Partners, Ltd.

(57) ABSTRACT

An elongated extruded plastic corner post for protecting a packaged product. The corner post comprises an outer wall and an inner wall joined at the ends to define a substantially L-shaped cylindrical space therebetween, and one or more integrally formed ribs connecting opposing faces of the inner and outer walls. The corner post protects packaged appliances by directing lateral forces directly to the structural framework of the appliance. In another embodiment, the extruded plastic corner post comprises two elongated legs joined along an inner corner and forming a spring-like profile. The spring-like profile compresses to absorb lateral shocks.

10 Claims, 5 Drawing Sheets

EXTRUDED CORNER POST FOR VERTICAL AND LATERAL PROTECTION

BACKGROUND

1. Field of the Invention

This patent relates to packaging for products such as washers, dryers and refrigerators. More particularly, this patent relates to an extruded plastic corner post for protecting packaged products from axial and lateral forces.

2. Description of the Related Art

Warehousing and distribution environments drive the need for devices that protect products from both axial (vertical) and lateral (horizontal) forces. Axial forces mainly are caused by stacking packaged products in warehouses. Lateral forces can be caused by stacking, clamp handling and basiloid handling, and also by collisions inherent in warehouse and distribution systems. For instance, it is not uncommon to move packaged appliances using clamp trucks in a block three units high, three units across and two units deep. Such clamp handling can impart lateral forces on the packaged products of up to 2,500 PSI.

Laminated corner posts consisting essentially of hollow paper tubes are a popular means for supporting and cushioning the corners of packaged appliances during storage and transport. When subjected to large lateral forces, many laminated paper corner posts comprises beaded structures that are designed to fold over on themselves. Once the paper corner post is folded upon itself, the lateral force is directed through the folded corner post to the structural frame of the packaged appliance, thereby protecting the relatively weaker sidewalls. Although paper corner posts that fold over and lose their original shape are well suited to protect appliances from damage, they do not prevent the container surrounding the appliance from collapsing inwardly when the container is subjected to large lateral forces. Laminated paper support posts also can degrade in high humidity or wet conditions, which can occur during assembly line product testing.

Thus it is a primary object of the present invention to provide an improved corner post that can withstand vertical and lateral forces without the foldover effect found with laminated paper posts.

Another object of the invention is to provide a corner post that does not degrade in high humidity or wet conditions.

Still another object of the invention is to provide a corner post that maintains the distance between the container and the product, thereby preventing the container from collapsing inwardly.

Yet another object of the present invention is to provide a corner post having enhanced axial strength.

Further and additional objects will appear from the description, accompanying drawings, and appended claims.

SUMMARY OF THE INVENTION

The present invention is an elongated extruded plastic corner post for protecting a packaged product. In one embodiment referred to as the tube type corner post, the corner post comprises an outer wall and an inner wall joined at the ends to define a substantially L-shaped cylindrical space therebetween, and one or more integrally formed ribs connecting opposing faces of the inner and outer walls. The ribs may be planar or arcuately shaped. If the ribs are planar, they may be perpendicular to the inner and outer walls or set obliquely thereto.

The tube type corner post may be formed with cut out portions to accommodate and protect protruding components of the packaged product, such as handles and the like. The inner and outer walls of the corner post may be formed with beads to enhance the axial strength of the post.

The tube type corner post is best used with appliances and other products having thin walls mounted on a relatively strong structural framework. The tube type corner post protects the packaged product by directing lateral forces directly to the structural framework.

In another embodiment, the extruded corner post comprises two elongated legs joined along an inner corner and forming a spring-like profile. Each leg of the spring-like profile corner post comprises a planar inner segment extending from an inner corner and terminating at a first bend, a rib extending from the first bend outwardly to a second bend, and a planar outer segment extending from the second bend along a plane substantially parallel to the plane of the inner segment. The inner segment, rib and outer segment are integrally formed by a plastic extrusion process.

The spring-like profile corner post absorbs lateral shocks to the container by flattening or compressing. When the lateral force subsides, the corner post returns to its original shape.

THE DRAWINGS

DETAILED DESCRIPTION OF THE INVENTION

The invention is a corner post used for protecting packaged products. The corner post is of unitary construction, being made from extruded plastic, and is designed to provide both lateral and axial compression resistance without foldover, that is, without losing its shape. The present invention includes two types of extruded corner posts: tube type and spring-like open profile type.

Tube Type Extruded Corner Post

The tube type extruded corner post is so-called because the walls of the post form an enclosed cylindrical tube having a substantially hollow interior. However, unlike conventional corner posts made from convolutely wound paper, the extruded corner post of the present invention includes integrally formed extruded plastic ribs extending between the opposing walls of the post. As explained below, these ribs protect the walls of an appliance by directing lateral forces to the relatively stronger structural frame of the appliance.

Figure 1:
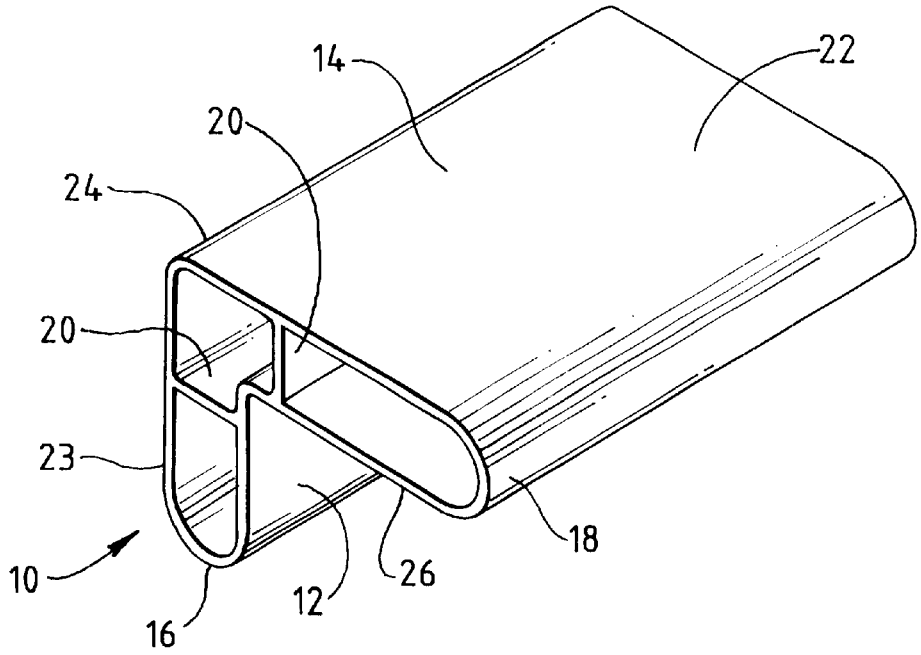
FIG. 1 is perspective view of a first embodiment of an extruded corner post according to the present invention.
Figure 2:
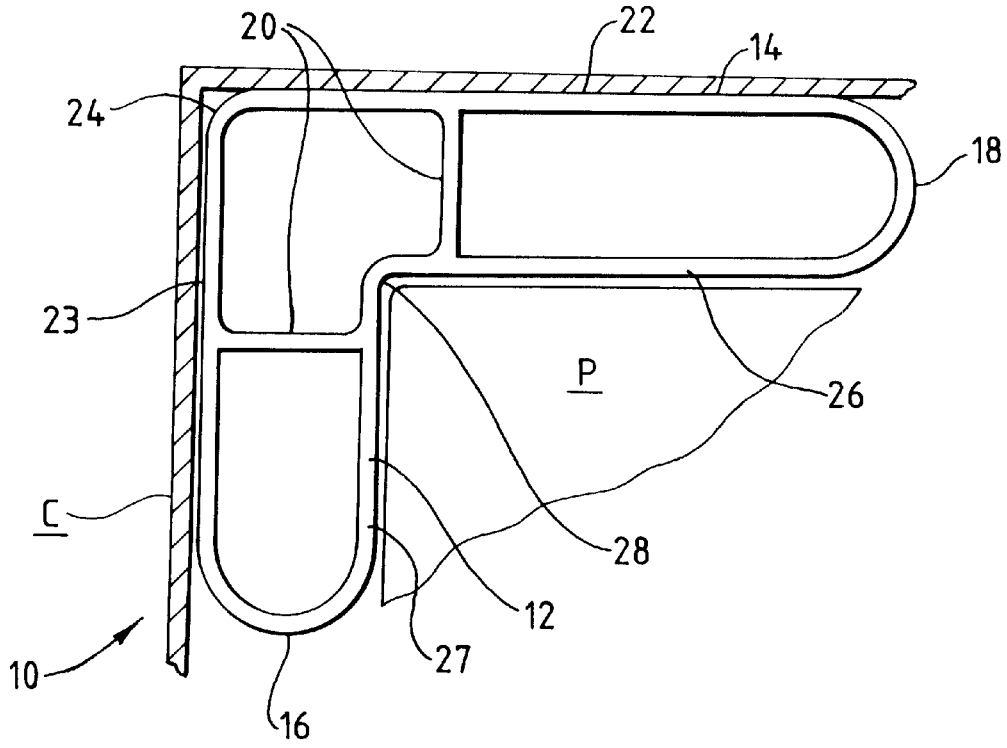
FIG. 2 is a top plan view of the corner post of FIG. 1 shown installed between a product and a container.

Turning to the drawings, there is shown in FIGS. 1 and 2 an elongated extruded plastic corner post 10 for protecting a packaged product, such as an appliance. The corner post 10 comprises an inner wall 12 and an outer wall 14 connected at the ends 16, 18 of the corner post 10 to form a substantially hollow cylindrical tube. The outer wall 14 has two substantially planar legs 22, 23 which are substantially perpendicular to each other and connected along an outer apex 24. When the corner post 10 is installed between a product P and a container C as illustrated in FIG. 2, the outer wall 14 is adjacent the inside walls of the container C.

The inner wall also has two substantially planar legs 26, 27 which are substantially perpendicular to each other and connected at an inner corner 28. When installed, the inner legs 26, 27 are adjacent the product P being protected. The inner wall 12 is substantially coextensive with the outer wall 14, meaning the inner wall and outer walls 12, 14 have substantially the same vertical and horizontal dimensions. The inner wall and outer walls 12, 14 are joined at the ends 16, 18 of the corner post 10 away from the apex 24 and inner corner 28. Preferably, the ends 16, 18 are curved as shown in FIGS. 1 and 2. The walls 12, 14 are substantially parallel and are laterally spaced from one another a distance d.

Longitudinal webs or ribs 20 connect the opposing faces of the inner and outer walls 12, 14 along areas between the vertical ends 16, 18. Preferably, the ribs 20 are perpendicular to the inner and outer walls 12, 14, as depicted in FIGS. 1 and 2. Perpendicular ribs 20 allows the corner post 10 to maintain the distance between the container and the product when the container is subjected to lateral forces, thereby preventing the container from collapsing inwardly.

Alternatively, the ribs may be form an oblique angle with respect to the outer and inner walls 12, 14. Such a configuration would reduce the lateral strength of the corner post but would lessen the possibility of the ribs shattering when subjected to very large lateral forces.

The ribs 20 may be disposed anywhere along the legs of the corner post 10. While the illustrated embodiment shows a pair of ribs 20, one disposed within each leg of the corner post 10, any number of ribs may be incorporated into the design of the extruded corner post 10. Preferably the ribs are substantially planar, that is, they have a substantially linear horizontal cross section, as shown in FIGS. 1 and 2. Such ribs may hereinafter be referred to as "straight" ribs. Alternatively, the ribs may be curved, that is, have an arcuate horizontal cross section, as described below with respect to the embodiment illustrated in FIGS. 3 and 4.

The corner post of the present invention is formed by an extrusion process in which melted polymer is discharged through a die configured to produce a corner post having the desired cross sectional shape. The inner and outer walls and connecting ribs form a single unitary structure. Plastic extrusion is particular well suited for making corner posts of varying heights. Different cross sectional shapes can be achieved by using different dies. The thickness of the walls and ribs, the distance between the walls and the curvature of the ends may be varied as needed.

The extruded tube type corner post is particularly useful in protecting appliances having thin metal walls affixed to a rigid structural frame. The appliance frame usually has a structural area located near the top and/or bottom of the vertical profile of the appliance. This area, unlike the relatively weaker sidewalls, can withstand large lateral forces.

Referring to FIG. 2, when the extruded corner post 10 is placed between the appliance P and the container C such that a portion of each rib 20 is adjacent a structural area of the appliance 22, the ribs 20 can transfer lateral forces directly to the structural area, thereby protecting the relatively weaker sidewalls from damage. And because the extruded corner post does not collapse, it maintains the distance between the container C and the appliance P, thereby preventing the container C from collapsing inwardly.

The ribs 20 may extend the full longitudinal height of the corner post 10 or less than the full height. If the ribs extend less than the full height of the post, it is preferred that they at least extend along that area of the corner post 10 adjacent the structural area of the appliance so as to be able to transfer outside forces directly to the structural areas of the appliance.

Figure 3:
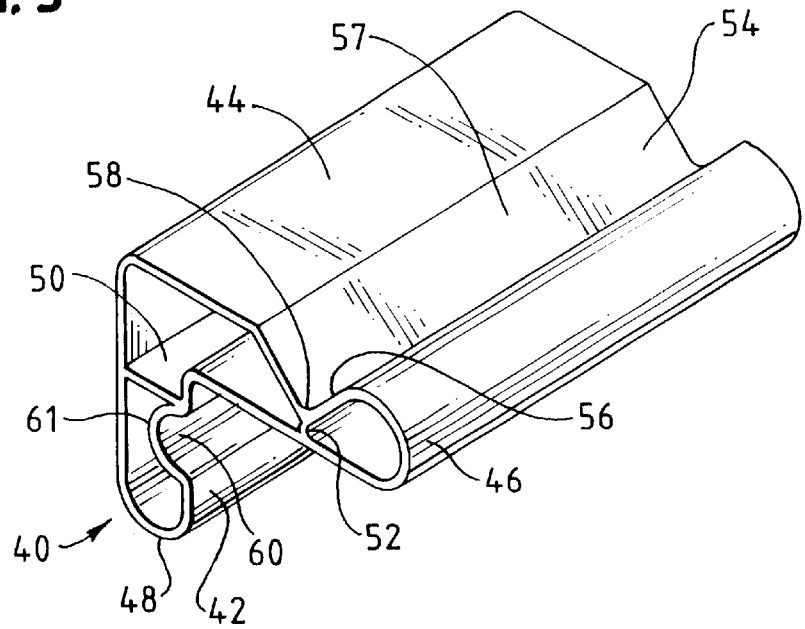
FIG. 3 is a perspective view of a second embodiment of an extruded corner post according to the present invention.
Figure 4:
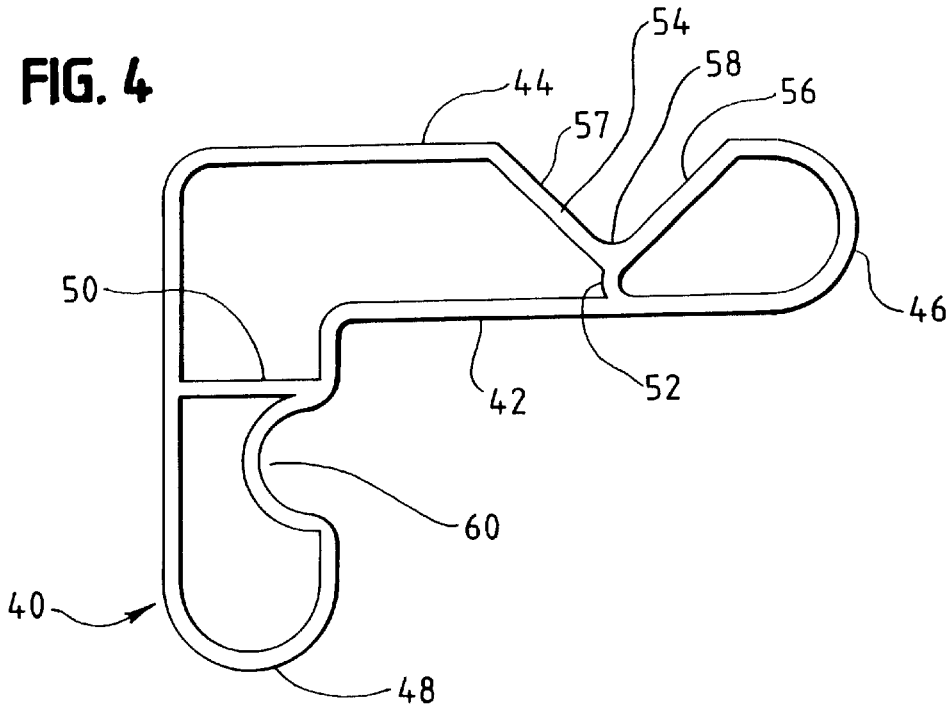
FIG. 4 is a top plan view of the corner post of FIG. 3.

FIGS. 3 and 4 illustrate a second embodiment of the extruded plastic corner post of the present invention having some additional optional features not shown in the embodiment depicted in FIGS. 1 and 2. Like the first embodiment, the corner post 40 comprises substantially L-shaped coextensive inner and outer walls 42, 44 joined at opposite ends 46, 48 or the corner post to form a substantially hollow elongated tube having a substantially L-shaped cross section. Also like the first embodiment, the corner post 40 has a straight rib 50 disposed between the ends 46, 48 and connecting the opposing faces of the inner and outer walls 42, 44. The rib 50 is perpendicular to the inner and outer walls 42, 44.

As shown in FIGS. 3 and 4, the ribs need not be straight. The corner post 40 has a curved rib 52 disposed between the ends 46, 48 of the corner post 40 and connecting the inner and outer walls 42, 44 along one leg of the post 40. Curved ribs, because of their shape, are more flexible than straight ribs, and may be used where increased flexibility is desired.

Whether straight or curved, the ribs may extend between substantially flat opposing wall surfaces, between a flat wall surface and an opposing bead, or between two opposing beads. In the embodiment shown in FIGS. 3 and 4, the straight rib 50 extends between two substantially flat opposing wall surfaces 42, 44, and the curved rib 52 extends between a substantially flat wall surface 42 and an opposing bead 54.

The bead 54 is disposed in the outer wall 44 and is directed inwardly toward the hollow interior of the corner post 40. The bead 54 is V-shaped and comprises inwardly slanting opposing walls 56, 57 meeting at a juncture or apex 58. The bead 54 improves the axial compression characteristics of the corner post 40. If desired, more than one bead may be formed in the outer wall 42. Alternatively, or in addition to the outer wall bead 54, one or more beads may be disposed in the inner wall 42. The outer and inner wall beads may be V-shaped, U-shaped or any other suitable shape. In this particular embodiment, the curved rib 52 extends between the flat surface of the inner wall 42 and the juncture 58, although the curved rib may also extend between opposing flat surfaces.

Returning to FIGS. 3 and 4, it can be seen that the corner post 40 may have a bead or cut out portion 60 disposed along the inner wall 42 to surround and protect product components that protrude beyond the plane of the product walls, such as handles, knobs and hinges. The cut out portion 60 may be formed in any suitable shape to accommodate the geometry of the component to be protected.

The Spring-Like Profile Extruded Corner Post

The spring-like profile extruded corner post is so-called because the walls of the post act in a spring-like fashion to absorb lateral shocks, rather than directing forces to a specific area as with the tube type extruded corner post. The spring-like extruded corner post has an open profile, that is, it does not form an enclosed hollow tube.

Figure 5:
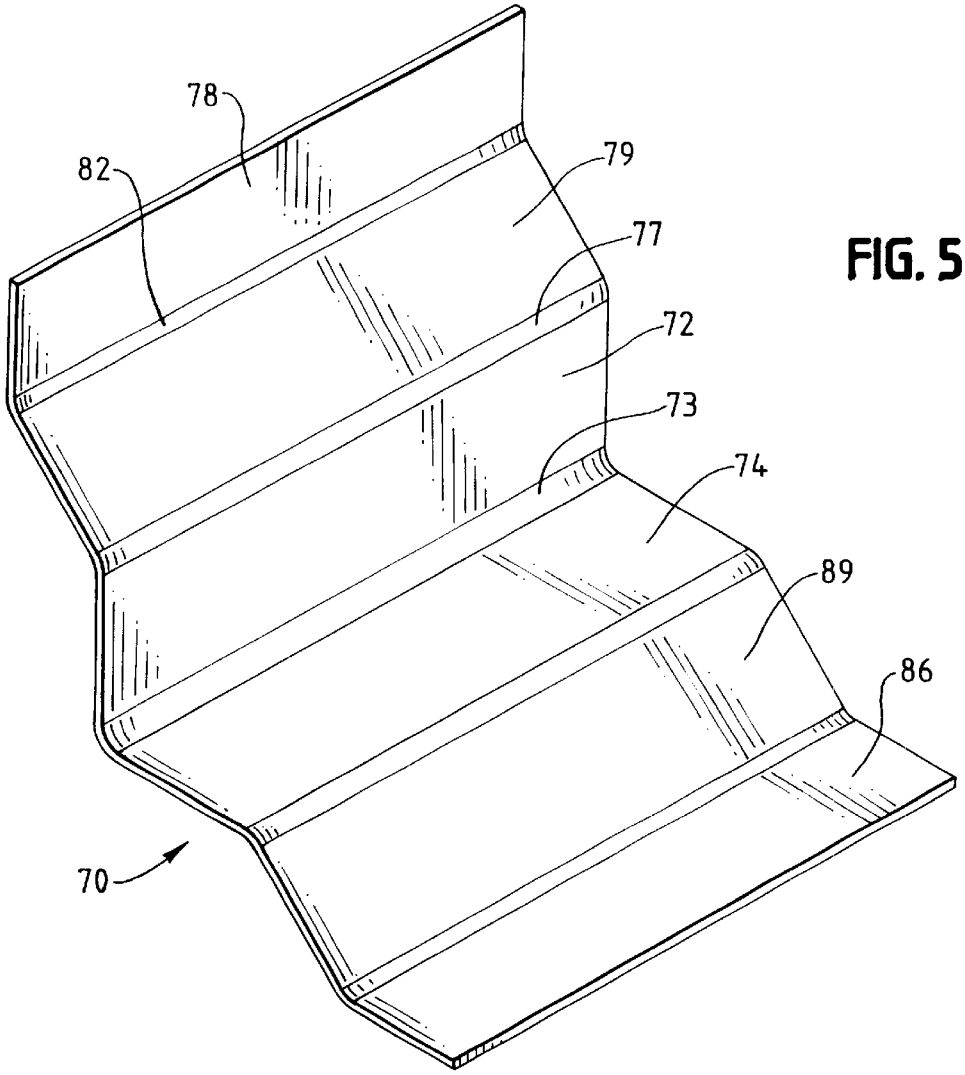
FIG. 5 is a perspective view of a third embodiment of an extruded corner post according to the present invention.
Figure 6:
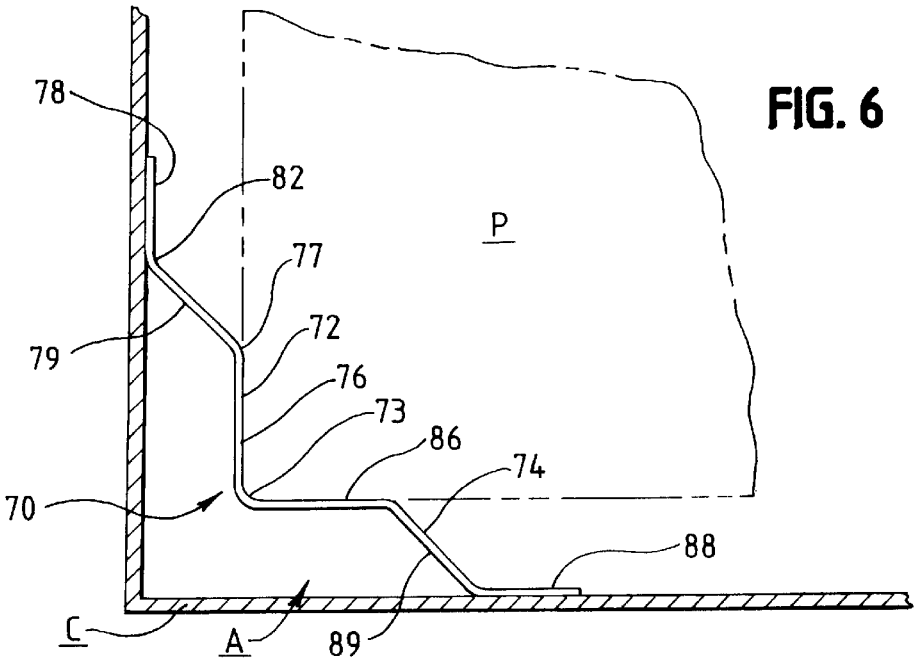
FIG. 6 is a top plan view of the corner post of FIG. 3 shown installed between a container and a product.

Three embodiments of the spring-like profile embodiment are shown in FIGS. 5 to 9. FIGS. 5 and 6 show a first embodiment of a spring-like corner post 70 comprising two legs 72, 74 forming a substantially right angle and joined along an inner corner 73. The first leg 72 comprises a substantially planar inner segment 76 extending away from the inner corner 73 and terminating at a first bend 77, a substantially planar rib 79 extending from the first bend away from the second leg 74 to a second bend 82, and a substantially planar outer segment 78 extending from the second bend 82 in a direction away from the second leg 74 and along a plane substantially parallel to the plane of the inner segment 76. The substantially planar rib 79 connects the inner and outer segments 76, 78 and defines an obtuse angle, preferably about 135 degrees, with respect to both the inner and outer segments 76, 78.

Alternatively, as discussed below with respect to FIG. 9, the rib may have a curved horizontal cross section. In such instances the rib may curve outward, away from the container corner c, or inward, toward the corner c.

The second leg 74 is similarly configured, having inner and outer segments 86, 88 connected by a rib 89. When in use, both inner segments, 76, 86 are adjacent the walls of the product P being protected, and both outer segments 78, 88 are adjacent the inside walls of the container C.

The corner post 70 and the container C define a buffer or cushion area A. When lateral force is exerted on the container C, the corner post 70 flattens somewhat as the outer segments 78, 88 slide along the inside surface of the container C in a direction away from the container corner c. The flattening or compression temporarily reduces the volume of the cushion area A until the lateral force is relieved.

Figure 7:
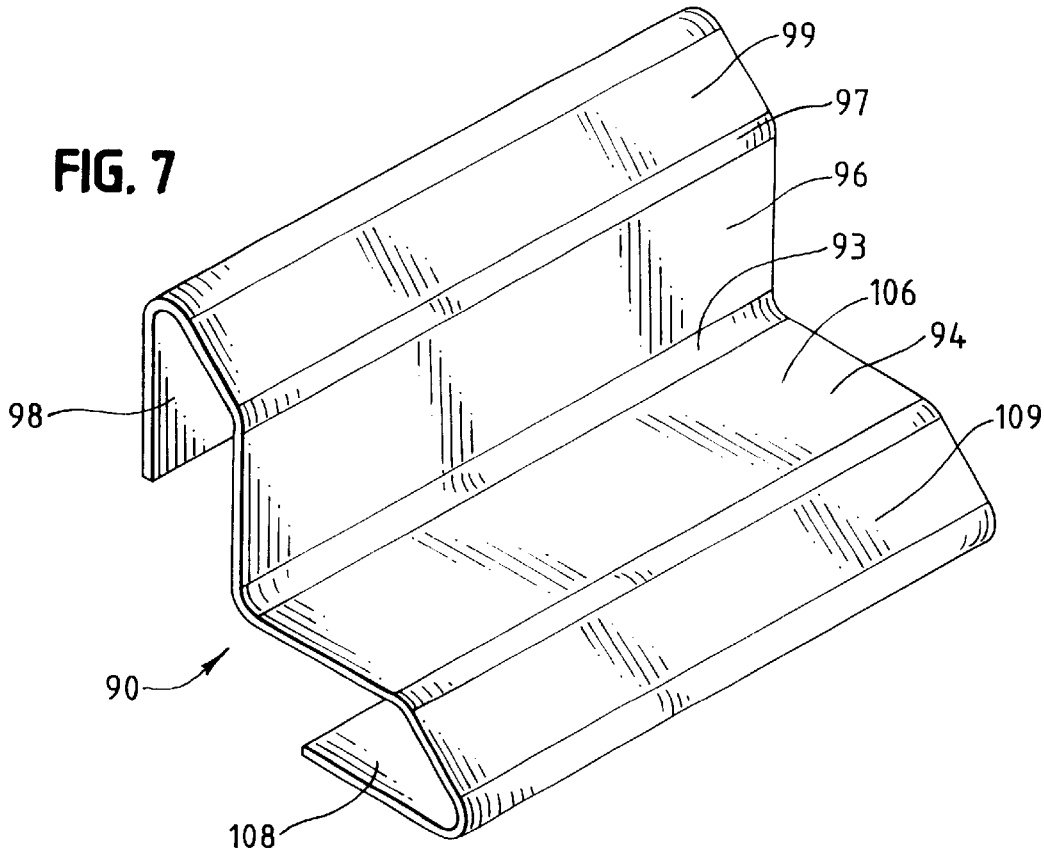
FIG. 7 is a perspective view of a fourth embodiment of an extruded corner post according to the present invention.
Figure 8:
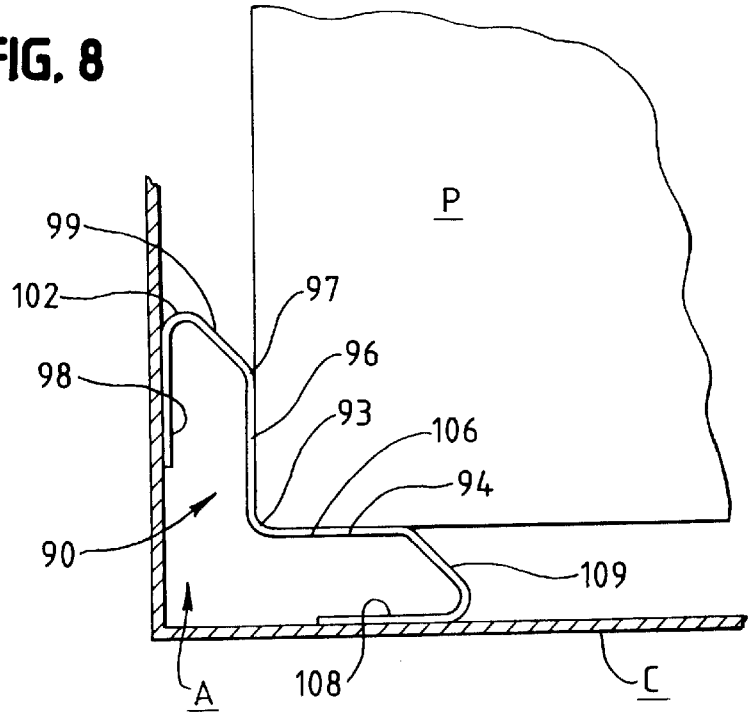
FIG. 8 is a top plan view of the corner post of FIG. 7 shown installed between a container and a product.

FIGS. 7 and 8 illustrate another embodiment of a spring-like extruded corner post 100 similar to that of FIGS. 5 and 6 except that the ribs 99, 109 form acute angles with respect to the outer segments 98, 108 respectively. Like the embodiment shown in FIGS. 5 and 6, the corner post 70 shown in FIGS. 7 and 8 comprises two legs 92, 94 forming a right angle and joined at an inner corner 93. The first leg 92 comprises an inner segment 96 extending along a plane away from the inner corner 93 and terminating at an end 97, a substantially planar rib 99 extending from the first bend 97 away from the second leg 94 to a second bend 102, and a substantially planar outer segment 98 extending from the second bend 82 in a direction toward second leg 96 and along a plane substantially parallel to the plane of the inner segment 96. The rib 99 may be planar as illustrated in FIGS. 7 and 8 or any suitable shape. The rib 99 forms an obtuse angle with respect to the first leg inner segment 92. The first leg outer segment 98 bends back upon the rib 99 such that the rib 99 and the first leg outer segment 98 define an acute angle, preferably one of about 45 degrees.

The second leg 94 is similarly configured, having inner and outer segments 106, 108 connected by a rib 109. When placed inside a container C between a product P and the inside walls of the container C, both inner segments, 96, 106 are adjacent the walls of the product P being protected, and both outer segments 98, 108 are adjacent the inside walls of the container C. When the container C is acted upon by a lateral force, the corner post 70 compresses to protect and cushion the product P inside the container C.

Figure 9:
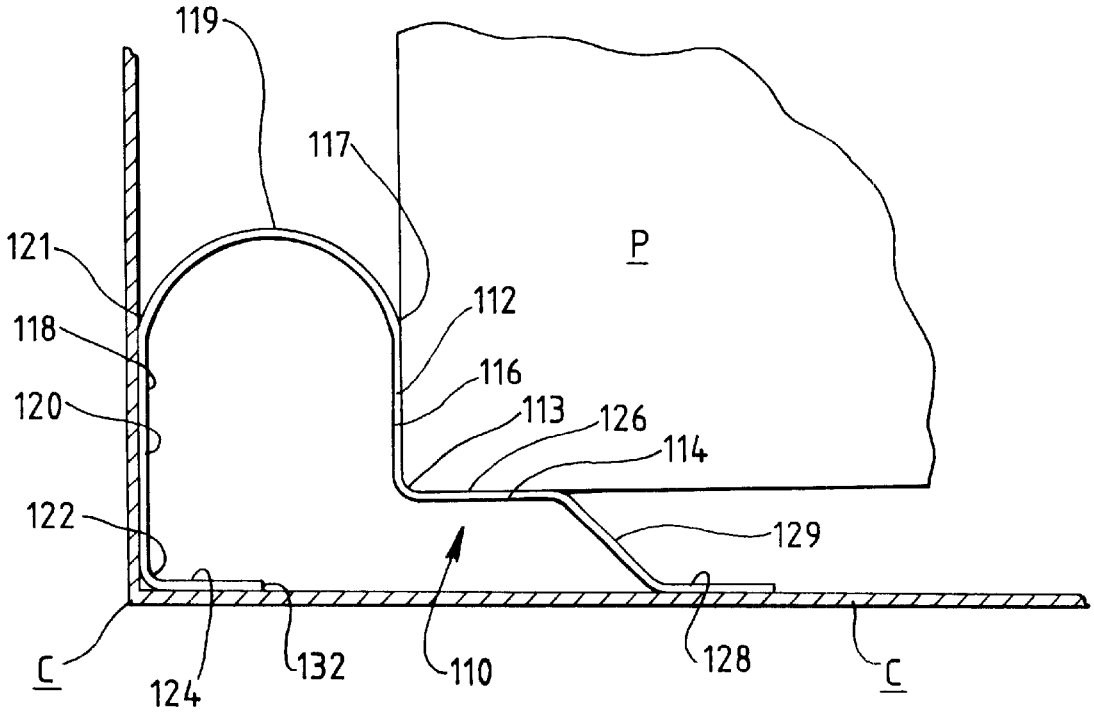
FIG. 9 is a top plan view of a fifth embodiment of a corner post according to the invention, shown installed between a container and a product.

FIG. 9 illustrates yet another embodiment of a spring-like profile extruded corner post, one having a curved rib. The corner post 110 has two legs 112, 114 joined at an inner corner 113. The second leg 114 is similar in configuration to the second leg 74 of the corner post 70 illustrated in FIGS. 5 and 6. That is, it comprises a substantially planar rib 129 connecting substantially planar inner and outer segments 126, 128 and forming obtuse angles therewith.

The first leg 112 comprises a substantially planar inner segment 116 extending away from the inner corner 113 and terminating at a first bend 117, an outwardly curved rib 119 extending from the first bend 117 to a second bend 121, and an outer segment 118 extending from the second bend 121. The outer segment 118 comprises first and second substantially planar portions 120, 124. The first planar portion extends from the second bend 121 parallel to the first leg inner segment 116 such that the first planar portion 120 and the first leg inner segment 116 substantially opposite each other, and terminates in a right angle bend or apex 122. The second planar portion 124 extends from the apex 122 and terminates in a free end 132. The second planar portion 124 is coplanar with the second leg outer segment 128.

When the extruded corner post 110 is installed inside a container C around a product P, the inner corner 113 is adjacent a corner of the product P, the inner segments 116, 126 are adjacent contiguous walls of the product P, and the outer segments 118, 128 are adjacent contiguous inside walls of the container C.

Thus there has been described an extruded elongated corner post to be used in the packaging industry to protect products during distribution. The corner post may have a closed tubular shape or an open spring-like shape. With respect to the tube type extruded corner post, the rib shape location can be varied to direct lateral forces imparted during distribution to the strongest area of the product being protected and to enhance column strength, thereby reducing product damage. The enhanced column strength of the tubular type extruded corner post insures that stacked units in warehouses and transportation vehicles remain upright to eliminate leaning stacks that can cause potentially dangerous situations and product damage.

The open profile spring-like extruded corner post absorbs lateral shock by flattening or compressing, then returning to its original shape. When a lateral force is imparted on the container, the spring-like corner post flattens, temporarily reducing the buffer area between the container and the product. As the lateral force dissipates, the spring-like corner post returns to its original non-compressed state.

Other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. An elongated extruded plastic corner post for protecting a packaged product, the corner post comprising:

an outer wall having two substantially planar leg members connected longitudinally along an outer apex, said leg members being substantially perpendicular;

an inner wall having two substantially planar leg members connected longitudinally along an inside corner, said inner wall being substantially coextensive with said outer wall, said inner and outer walls being substantially parallel and laterally spaced from one another, said inner and outer walls being joined at opposing ends to define a substantially L-shaped cylindrical space therebetween; and a longitudinal rib connecting opposing faces of the outer and inner walls, said rib being integrally formed with the outer and inner walls.

2. The extruded corner post of claim 1 wherein the rib is substantially planar.

3. The extruded corner post of claim 2 wherein the rib is perpendicular to both the inner and outer walls.

4. The extruded corner post of claim 1 wherein the rib is has an arcuate horizontal cross section.

5. The extruded corner post of claim 1 further comprising a cut out portion disposed along the inner wall, said cut out portion extending inwardly toward the outer wall and defining a space to accommodate a protruding component of the packaged product.

6. The extruded corner post of claim 1 in which the rib extends the full longitudinal height of the corner post.

7. The extruded corner post of claim 1 further comprising a longitudinal bead disposed in the outer wall and extending inward toward the substantially L-shaped cylindrical space, said bead having an apex, said rib extending between the bead apex and the inner wall.

8. The extruded corner post of claim 7 in which the bead is substantially V-shaped.

9. The extruded corner post of claim 1 further comprising a longitudinal bead disposed in the inner wall and extending inward toward the substantially L-shaped cylindrical space, said bead having an apex, said rib extending between the bead apex and the outer wall.

10. The extruded corner post of claim 9 in which the bead is substantially V-shaped.

* * * * *